US008927186B2

(12) United States Patent
Ishii et al.

(10) Patent No.: US 8,927,186 B2
(45) Date of Patent: Jan. 6, 2015

(54) TONER, AND DEVELOPER, IMAGE FORMING METHOD AND PROCESS CARTRIDGE USING THE TONER

(75) Inventors: Masayuki Ishii, Shizuoka-ken (JP); Toyoshi Sawada, Kanagawa-ken (JP)

(73) Assignee: Ricoh Company, Limited, Tokyo (JP)

( * ) Notice: Subject to any disclaimer, the term of this patent is extended or adjusted under 35 U.S.C. 154(b) by 698 days.

(21) Appl. No.: 12/952,776

(22) Filed: Nov. 23, 2010

(65) Prior Publication Data

US 2011/0136051 A1 Jun. 9, 2011

(30) Foreign Application Priority Data

Dec. 8, 2009 (JP) ..... 2009-278604
Jul. 28, 2010 (JP) ..... 2010-169083

(51) Int. Cl.

| | |
|---|---|
| ***G03G 9/08*** | (2006.01) |
| ***G03G 9/00*** | (2006.01) |
| ***G03G 9/097*** | (2006.01) |
| ***G03G 9/09*** | (2006.01) |

(52) U.S. Cl.

CPC ..... *G03G 9/0812* (2013.01); *G03G 9/09716* (2013.01); *G03G 9/0906* (2013.01); *G03G 9/09725* (2013.01); *G03G 9/0926* (2013.01); *G03G 9/09708* (2013.01)

USPC ..... 430/108.2; 430/108.1; 430/108.3; 430/137.1; 430/137.16; 430/137.18

(58) Field of Classification Search

USPC ..... 430/108.1, 108.2, 108.24, 108.6, 108.7, 430/108.3, 137.1, 137.16, 137.18

See application file for complete search history.

(56) References Cited

U.S. PATENT DOCUMENTS

| | | | | |
|---|---|---|---|---|
| 7,803,508 | B2 | 9/2010 | Ishii et al. | |
| 2005/0196692 | A1 * | 9/2005 | Yamashita et al. | 430/108.3 |
| 2009/0142685 | A1 * | 6/2009 | Nagatomo et al. | 430/108.6 |
| 2009/0170019 | A1 * | 7/2009 | Kuramoto et al. | 430/108.22 |

FOREIGN PATENT DOCUMENTS

| | | | |
|---|---|---|---|
| JP | 8-146657 | | 6/1996 |
| JP | 9-304961 | | 11/1997 |
| JP | 2002287412 | A * | 10/2002 |
| JP | 2005-70187 | | 3/2005 |
| JP | 2007-156099 | | 6/2007 |
| JP | 2007-248911 | | 9/2007 |
| JP | 2007-279702 | | 10/2007 |
| JP | 2007314356 | A * | 12/2007 |
| JP | 2008-116568 | | 5/2008 |

OTHER PUBLICATIONS

Machine translation of JP 2007314356 A.*
Machine Translation of JP 2002-287412 A.*
Office Action issued Jan. 17, 2014 in Japanese Patent Application No. 2010-169083.

* cited by examiner

*Primary Examiner* — Jonathan Jelsma
(74) *Attorney, Agent, or Firm* — Oblon, Spivak, McClelland, Maier & Neustadt, L.L.P.

(57) ABSTRACT

A toner for use in developing an electrostatic latent image is provided. The toner includes a colored particulate material including at least a binder resin and a colorant; and an external additive present on a surface of the colored particulate material and including a particulate crystalline hydroxyapatite. The particulate crystalline hydroxyapatite has an average aspect ratio of not less than 3 and less than 30.

9 Claims, 1 Drawing Sheet

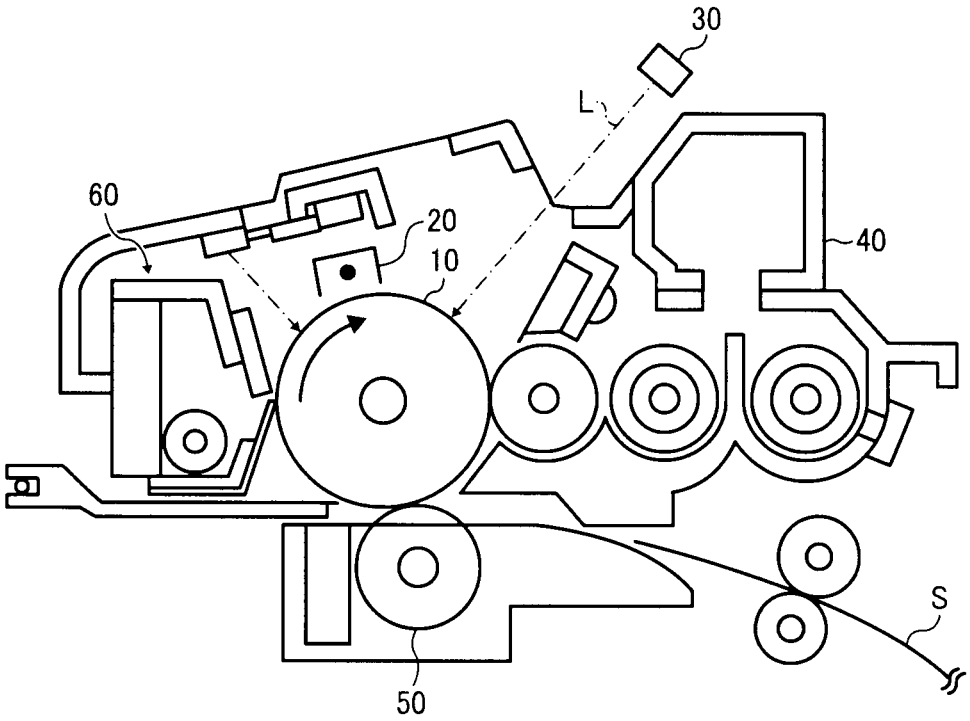
30
L
60
20
10
40
S
50

TONER, AND DEVELOPER, IMAGE FORMING METHOD AND PROCESS CARTRIDGE USING THE TONER

BACKGROUND OF THE INVENTION

1. Field of the Invention

The present invention relates to a toner, and to a developer, an image forming method and a process cartridge using the toner.

2. Description of the Related Art

There are a number of electrophotographic image forming methods. Such electrophotographic image forming methods typically include the following processes:

(1) Forming an electrostatic latent image on an image bearing member including a photosensitive material such as a photoreceptor (latent image forming process);

(2) Developing the electrostatic latent image with a developer including a toner to form a toner image on the image bearing member (developing process);

(3) Transferring the toner image onto a recording material such as paper (transferring process);

(4) Fixing the toner image on the recording material upon application of heat, pressure, a combination of heat and pressure, a vaporized solvent, or the like, resulting in formation of an output image (fixing process); and (5) Cleaning the surface of the image bearing member to remove residual toner particles therefrom (cleaning process).

A particulate material having an average particle diameter on the order of from a few nanometers to tens of micrometers is used as an external additive of conventional toners. In attempting to impart a good combination of charging property, fluidity and hydrophobicity to toner, a hydrophobized particulate silica is typically used as an external additive, and a hydrophobized titanium oxide is used in attempting to decrease variation of chargeability and charge quantity of toer caused by change of environmental conditions.

In attempting to improve stability and performance of electrophotographic image forming apparatus, toner including two or more of these external additives has been used for the image forming apparatus while adjusting the mixing ratio thereof.

Recently, various modifications have been performed on the main body (i.e., mother toner or toner particles) of toner in attempting to improve the properties of the toner. Specific examples of such modifications are as follows:

(1) The amount of a wax included in toner particles is increased so that the wax is used efficiently (i.e., a good releasability is imparted to the toner) when the toner is fixed;

(2) A wax is mainly included in a surface portion of toner particles so as to be used efficiently when the toner is fixed; and (3) A crystalline material is included in toner particles so that the toner can be easily melted in a fixing process with relatively low heat energy.

Such modified toners (1) and (2) tend to cause a phenomenon in which a wax included in toner particles exudes from the toner particles when environmental conditions and conditions of the image forming apparatus change, thereby deteriorating the properties of the toner and the developer, resulting in deterioration of image quality. The modified toner (3) tends to cause a phenomenon in which an alcohol component used for preparing such a crystalline material remains in the toner particles in a small amount, thereby deteriorating the property of the toner.

For these reasons, there is a need for a toner which can produce high quality images for a long period of time without causing such a wax and/or alcohol exuding phenomenon as mentioned above.

SUMMARY

This patent specification describes a novel toner for use in developing an electrostatic latent image, one embodiment of which includes a colored particulate material including at least a binder resin and a colorant, and an external additive including a particulate crystalline hydroxyapatite, which is present on a surface of the colored particulate material. The particulate crystalline hydroxyapatite has an average aspect ratio of not less than 3 and less than 30.

This patent specification further describes a novel developer including the above-mentioned toner and a carrier.

This patent specification further describes a novel image forming method, one embodiment of which includes forming an electrostatic latent image on an image bearing member; developing the electrostatic latent image with a developer including the above-mentioned toner to form a toner image on the image bearing member; and transferring the toner image onto a recording material.

This patent specification further describes a novel process cartridge, one embodiment of which includes an image bearing member configured to bear an electrostatic latent image thereon; and a developing device configured to develop the electrostatic latent image with a developer including the above-mentioned toner to form a toner image on the image bearing member, wherein the image bearing member and the developing device are integrated into a single unit.

BRIEF DESCRIPTION OF THE DRAWINGS

Amore complete appreciation of the aspects of the invention and many of the attendant advantage thereof will be readily obtained as the same better understood by reference to the following detailed description when considered in connection with the accompanying drawings, wherein:

FIGURE is a schematic view illustrating an example of the process cartridge of the present invention.

DESCRIPTION OF THE PREFERRED EMBODIMENTS

Initially, the toner of the present invention will be described.

The toner of the present invention includes a colored particulate material including at least a binder resin and a colorant, and an external additive including a particulate crystalline hydroxyapatite, which is present on the surface of the colored particulate material, wherein the particulate crystalline hydroxyapatite has an average aspect ratio of not less than 3 and less than 30 (i.e., the particulate crystalline hydroxyapatite preferably has a rod-, needle- or plate-form). Since the toner having such a configuration hardly causes the above-mentioned wax (release agent) and/or alcohol exuding phenomenon, the toner can maintain good charging property for a long period of time. The reason why the toner hardly causes the wax and/or alcohol exuding phenomenon is not clearly determined, but is considered to be that the crystalline hydroxyapatite, which has a layered structure, can contain a proper amount of wax and/or alcohol in the layers thereof. Particularly, when the particulate hydroxyapatite has a stick, needle or plate form, the hydroxyapatite can be satisfactorily adhered to the surface of toner particles, thereby heightening the effect.

The binder resin included in the colored particulate material of the toner of the present invention is not particularly limited, and known resins can be used. Specific examples thereof include homopolymers of styrene and substituted styrene such as polystyrene, poly-p-chlorostyrene, and polyvinyl toluene; styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, and styrene-maleic acid ester copolymers; acrylic resins such as polymethyl methacrylate, polybutyl methacrylate, and polyacrylic acid resins; and other resins such as polyvinyl chloride, polyvinyl acetate, polyethylene, polyesters, polyurethane resins, epoxy resins, polyvinyl butyral resins, rosin, modified rosins, terpene resins, phenolic resins, aliphatic or alicyclic hydrocarbon resins, aromatic petroleum resins, etc. These resins are used alone or in combination.

The colorant included in the colored particulate material of the toner is not particularly limited, and known dyes and pigments can be used therefor.

Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials are used alone or in combination.

The content of the colorant in the colored particulate material of the toner is preferably from 1% to 15% by weight, and more preferably from 3% to 10% by weight of the colored particulate material.

Master batches, which are complexes of a colorant with a resin, can also be used as the colorant of the toner.

Specific examples of the resins used for such master batches include homopolymers of styrene or styrene derivatives, styrene copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

The toner of the present invention optionally includes a release agent. Known waxes and the like materials can be used as the release agent. Specific examples of the waxes include waxes having a carbonyl group; polyolefin waxes such as polyethylene waxes and polypropylene waxes; long-chain hydrocarbons such as paraffin waxes and SAZOL waxes; etc.

Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone).

The melting point of the release agent for use in the toner is preferably from 40° C. to 160° C., more preferably from 50° C. to 120° C., and even more preferably from 60° C. to 90° C. When the melting point of the release agent is lower than 40° C., the high temperature preservability of the resultant toner tends to deteriorate. In contrast, when the melting point is higher than 160° C., the resultant toner tends to cause a cold offset problem in that a toner image adheres to a fixing roller when the toner image is fixed at a relatively low fixing temperature.

The release agent preferably has a melt viscosity of from 5 mPa·s to 1,000 mPa·s (i.e., 5 cps to 1,000 cps), and more preferably from 10 mPa·s to 100 mPa·s (i.e., 10 cps to 100 cps), at a temperature 20° C. higher than the melting point thereof. Release agents having a melt viscosity of lower than 5 mPa·s tends to deteriorate the releasability of the resultant toner. Release agents having a melt viscosity of higher than 1,000 mPa·s hardly produce a hot offset resistance improving effect and low temperature fixability improving effect.

The content of the release agent in the colored particulate material of the toner is generally from 1% to 40% by weight, and preferably from 3% to 30% by weight, based on the total weight of the colored particulate material of the toner. When the content is higher than 40% by weight, the fluidity of the toner tends to deteriorate.

The toner of the present invention optionally includes a charge controlling agent, i.e., a positive or negative charge controlling agent. In this regard, a charge controlling agent having a polarity opposite to the polarity of an electrostatic latent image formed on the surface of the image bearing member is used for the toner.

Specific examples of the marketed negative charge controlling agents include BONTRON S-31, S-32, S-34, S-36, S-37, S-39, S-40, S-44, E-81, E-82, E-84, E-86, E-88, A, 1-A, 2-A, and 3-A (which are manufactured by Orient Chemical Industries Co., Ltd.); KAYACHARGE N-1 and N-2, and KAYASET BLACK T-2 and 004 (which are manufactured by Nippon Kayaku Co., Ltd.); AIZEN SPIRON BLACK T-37, T-77, T-95, TRH and TNS-2 (which are manufactured by Hodogaya Chemical Co., Ltd.); FCA-1001-N, FCA-1001-NB, and FCA-1001-NZ (which are manufactured by Fujikura Kasei Co., Ltd.); etc.

Suitable materials for use as positive charge controlling agents include basic compounds such as Nigrosine dyes, cationic compounds such as quaternary ammonium salts, metal salts of higher fatty acids, etc. Specific examples of the marketed positive charge controlling agents include BONTRON N-01, N-02, N-03, N-04, N-05, N-07, N-09, N-10, N-11, N-13, P-51, P-52 and AFP-B (which are manufactured by Orient Chemical Industries Co., Ltd.); TP-302, TP-415, and TP-4040 (which are manufactured by Hodogaya Chemical Co., Ltd.); COPY BLUE PR, and COPY CHARGE PX-VP-435 and NX-VP-434 (which are manufactured by Hoechst A.G.); FCA 201, 201-B-1, 201-B-2, 201-B-3, 201-PB, 201-PZ, and 301 (which are manufactured by Fujikura Kasei Co., Ltd.); PLZ 1001, 2001, 6001 and 7001 (which are manufactured by Shikoku Chemicals Corp.); etc.

These materials can be used alone or in combination.

The content of such a charge controlling agent in the toner is not unambiguously determined, and is determined depending on the properties of the binder resin used, the method of preparing toner particles (including the dispersing method), etc. However, the content is generally from 0.1 parts to 10 parts by weight, and more preferably from 0.2 parts to 5 parts by weight, per 100 parts by weight of the binder resin included in the toner. When the content is higher than 10 parts by weight, the charge quantity of the toner excessively increases, thereby excessively increasing the electrostatic attraction between a developing roller and the toner, resulting in deterioration of fluidity of the toner and formation of low density images. By contrast, when the content is lower than 0.1 parts, the charge rising property and charge quantity of the resultant toner are not satisfactory, resulting in deterioration of the image quality.

The method for preparing the colored particulate material (toner particles) of the toner of the present invention is not particularly limited. For example, pulverization methods including kneading toner components (such as binder resins, colorants and release agents) while heating; cooling the kneaded toner component mixture; pulverizing the cooled toner component mixture; and then classifying the pulverized toner component mixture can be used. In addition, wet methods in which an oil phase liquid is emulsified, suspended or aggregated in an aqueous medium (such as suspension polymerization methods, emulsion polymerization methods and polymer suspension polymerization methods) can also be used.

The pulverization methods will be described in detail.

Initially, a mixture of toner components is subjected to a melt-kneading treatment using a melt kneader such as a continuous kneader (e.g., single- or double-screw extruders) and a batch kneader (e.g., roll mills).

Specific examples of the kneaders include KTK double-screw extruders manufactured by Kobe Steel, Ltd., TEM double-screw extruders manufactured by Toshiba Machine Co., Ltd., double-screw extruders manufactured by KCK Co., PCM double-screw extruders manufactured by Ikegai Corp., KO-KNEADER manufactured by Buss AG, etc.

It is preferable that the kneading operation is performed while controlling the kneading conditions so that the molecular chain of the binder resin used is not cut. For example, the kneading temperature is determined in consideration of the softening point of the binder resin used. Specifically, when the kneading temperature is much higher than the softening point of the binder resin used, the molecular chain of the binder resin is seriously cut. By contrast, when the kneading temperature is much lower than the softening point of the binder resin, the dispersion operation cannot be satisfactorily performed.

The thus-kneaded toner component mixture is then cooled and pulverized.

It is preferable for the pulverization process that the kneaded mixture is initially crushed (coarse pulverization), and then finely pulverized. Suitable pulverization methods include jet air pulverization methods in which jet air is applied to a kneaded toner component mixture such that the mixture collides against a collision plate or in which jet air is applied to the kneaded toner component mixture such that particles of the mixture collide against each other, and pulverization methods in which the kneaded mixture is pulverized at a narrow gap formed by a mechanically rotated rotor and a stator.

In the classification process, the pulverized toner component mixture is classified to prepare a colored particulate material of the toner (i.e., toner particles) having a desired particle diameter distribution. For example, fine particles are removed from the pulverized toner component mixture using a classifier such as cyclones, decanters, and classifiers using a centrifugal force. In addition, the thus-prepared colored particles may be filtered using a screen with 250-mesh or more to prepare a colored particulate material having a desired particle diameter distribution.

The colored particulate material of the toner of the present invention is preferably prepared by dispersing a solution or dispersion, which is prepared by dissolving or dispersing toner components including at least a polyester raw material having a group having an active hydrogen atom and a polyester resin (hereinafter referred to as a prepolymer (A)) reactive with an active hydrogen atom in an organic solvent, and then dispersing the solution or dispersion in an aqueous medium including a particulate resin, followed by reacting the prepolymer (A) with a compound having an active hydrogen group to prepare toner particles in the aqueous medium. In this regard, the toner components can include other toner components such as colorants and release agents.

The prepolymer (A) is prepared by reacting a polyester resin, which is a polycondensation product of a polyol (1) and a polycarboxylic acid (2), with a polyisocyanate (3).

Specific examples of the groups having an active hydrogen atom include hydroxyl groups (alcoholic hydroxyl groups and phenolic hydroxyl groups), amino groups, carboxyl groups, and mercapto groups, but are not limited thereto. Among these groups, alcoholic hydroxyl groups are preferable.

Suitable materials for use as the polyol (1) include diols (DIO), polyols (TO) having three or more hydroxyl groups, and mixtures of DIO and TO.

Specific examples of the diols include alkylene glycols (e.g., ethylene glycol, 1,2-propylene glycol, 1,3-propylene glycol, 1,4-butane diol, and 1,6-hexane diol); alkylene ether glycols (e.g., diethylene glycol, triethylene glycol, dipropylene glycol, polyethylene glycol, polypropylene glycol, and polytetramethyleneether glycol); alicyclic diols such as 1,4-cyclohexane dimethanol and hydrogenated bisphenol A; bisphenol compounds such as bisphenol A, bisphenol F, bisphenol S, 4,4'-dihydroxybiphenyl compounds (e.g., 3,3'-difluoro-4,4'-dihydroxybiphenyl); bis(hydroxyphenyl)alkane compounds (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluorobisphenol A), and 2,2-bis(3-hydroxyphenyl)-1,1,1,3,3,3-hexafluoropropane); bis(4-hydroxyphenyl)ether compounds (e.g., bis(3-fluoro-4-hydroxyphenyl)ether); adducts of the above-mentioned alicyclic diols with an alkylene oxide (such as ethylene oxide, propylene oxide and butylene oxide); adducts of the above-mentioned bisphenol compounds with an alkylene oxide (such as ethylene oxide, propylene oxide and butylene oxide); etc.

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

These diols (DIO) and polyols (TO) can be used alone or in combination.

Suitable materials for use as the polycarboxylic acid (2) for use in preparing the polyester resin include dicarboxylic acids (DIC) and polycarboxylic acids (TC) having three or more carboxyl groups.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acids, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl) hexafluoropropane, 2,2-bis(3-carboxyphenyl) hexafluoropropane, 2,2'-bis(trifluoromethyl)-4,4'-biphenyldicarboxylic acid, 2,2'-bis(trifluoromethyl)-3,3'-biphenyldicarboxylic acid, and hexafluoroisopropylidenediphthalic anhydride; etc. Among these compounds, alkenylene dicarboxylic acids having 4 to 20 carbon atoms and aromatic dicarboxylic acids having 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid), anhydrides and lower alkyl esters (e.g., methyl, ethyl and isopropyl esters) of the aromatic polycarboxylic acids, etc.

The above-mentioned polycarboxylic acids can be used alone or in combination.

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

The peak molecular weight of the thus-synthesized polyester resin is generally from 1,000 to 30,000, preferably from 1,500 to 10,000, and more preferably from 2,000 to 8,000. When the peak molecular weight is less than 1,000, the high temperature preservability of the resultant toner tends to deteriorate. By contrast, when the peak molecular weight is higher than 10,000, the low temperature fixability of the resultant toner tends to deteriorate.

Specific examples of the polyisocyanates (PIC) for use in preparing the polyester prepolymer (A) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is greater than 5, the low temperature fixability of the toner tends to deteriorate. By contrast, when the ratio is less than 1, the content of the urea group (and/or urethane group) in the resultant modified polyesters tends to decrease, thereby deteriorating the hot offset resistance of the toner.

The content of the polyisocyanate unit in a polyester prepolymer (A) having an isocyanate group is from 0.5% to 40% by weight, preferably from 1% to 30% by weight and more preferably from 2% to 20% by weight. When the content is lower than 0.5% by weight, the hot offset resistance of the toner tends to deteriorate. By contrast, when the content is higher than 40% by weight, the low temperature fixability of the toner tends to deteriorate.

The average number of the isocyanate group included in a molecule of a polyester prepolymer (A) is generally not less than 1, preferably from 1.5 to 3, and more preferably from 1.8 to 2.5. When the average number of the isocyanate group is smaller than 1, the molecular weight of the resultant modified polyester, which is crosslinked and/or extended, tends to decrease, thereby deteriorating the hot offset resistance of the resultant toner.

Urea-modified polyester resins for use as a binder resin of the toner of the present invention can be prepared by reacting a polyester prepolymer (A) having an isocyanate group with a molecular chain growing agent or crosslinking agent such as an amine (B).

Specific examples of such amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane, tetrafluoro-p-xylylene diamine, and tetrafluoro-p-phenylene diamine); alicyclicdiamines (e.g., 4,4'-diamino-3,3'-dimethyldicyclohexyl methane, diaminocyclohexane and isophoron diamine); aliphatic diamines (e.g., ethylene diamine, tetramethylene diamine, hexamethylene diamine, dodecafluorohexylene diamine, and tetracosafluorododecylene diamine); etc.

Specific examples of the polyamines (B2) having three or more amino groups include diethylene triamine, triethylene tetramine, etc.

Specific examples of the amino alcohols (B3) include ethanol amine, hydroxyethyl aniline, etc.

Specific examples of the amino mercaptans (B4) include aminoethyl mercaptan, aminopropyl mercaptan, etc.

Specific examples of the amino acids (B5) include aminopropionic acid, aminocaproic acid, etc.

Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc.

The molecular weight of the urea-modified polyesters can be controlled using a molecular chain growth inhibitor. Specific examples of such a molecular chain growth inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of a prepolymer (A) having an isocyanate group to the [NHx] group of an amine (B) is from 1/2 to 2/1, preferably from 1/1.5 to 1.5/1 and more preferably from 1/1.2 to 1.2/1. When the mixing ratio is greater than 2 or less than 1/2, the molecular weight of the resultant urea-modified polyester tends to decrease, resulting in deterioration of the hot offset resistance of the resultant toner.

The solvent used for dissolving or dispersing toner components is preferably a volatile solvent having a boiling point lower than 100° C. so as to be easily removed from the dispersion including the resultant toner particles. Specific examples of such volatile solvents include water-compatible or water-incompatible solvents such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, ester solvents such as methyl acetate and ethyl acetate, aromatic solvents such as toluene and xylene, and halogenated hydrocarbons such as methylene chloride, 1,2-dichloroethane, chloroform and carbon tetrachloride are preferably used.

When preparing a toner component solution or dispersion (hereinafter referred to as a toner component liquid), a method in which all the toner components are dissolved or dispersed in a solvent, or another method in which each of the toner components is dissolved or dispersed in a solvent, and then the solutions or dispersions are mixed, can be used. In the second-mentioned method, the solvents may be the same as or different from each other, but are preferably the same as each other because the solvents can be easily collected after the treatment.

The content of a resin component included in the toner component liquid is preferably from 40% to 80% by weight. When the resin content is greater than 80% by weight, it is difficult to dissolve or disperse toner components in an organic solvent, and in addition the resultant solution or dispersion has an extremely high viscosity, resulting in deterioration of the handling property of the toner component liquid. By contrast, when the resin content is less than 40% by weight, the amount of the produced toner particles decreases.

When a resin solution or dispersion, which includes a polyester resin and a prepolymer and which is used for a toner component liquid, is prepared, a method in which both the resin and prepolymer are dissolved or dispersed in a solvent, or a method in which each of the resin and prepolymer is dissolved or dispersed in a solvent, and then the solutions or dispersions are mixed, can be used. When the solubility and viscosity of the resin and prepolymer are different from each other, the second-mentioned method is preferably used.

When a toner component liquid is prepared, a colorant is dissolved or dispersed in a solvent by itself, or mixed with a resin solution or dispersion. In addition, if desired, a dispersing agent or a polyester resin can be added to the dispersion of a colorant. Alternatively, a master batch, which is a complex of a colorant with a resin, can be used as the colorant of the toner of the present invention.

When a wax serving as a release agent is dispersed in an organic solvent, known dispersing methods can be used. Specific examples of the dispersing methods include methods in which a mixture of a wax and an organic solvent is subjected to a dispersing treatment using a dispersing machine such as a bead mill; and methods in which a mixture of a wax and an organic solvent is heated to a melting point of the wax to prepare a solution, the solution is then cooled while agitated to prepare a dispersion, and the dispersion is further subjected to a dispersing treatment using a dispersing machine such as a bead mill. The second-mentioned dispersing methods have such an advantage that the dispersing time can be shortened. The release agent can include one or more waxes, and optionally includes a dispersing agent or a polyester resin for improving dispersibility of the waxes in a dispersion.

A toner component liquid, which is prepared by dissolving or dispersing toner components (such as a binder resin, a colorant and a release agent) in a solvent, is dispersed in an aqueous medium including a particulate resin. Suitable materials for use as the aqueous medium include water. In addition, organic solvents, which can be mixed with water, can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio (AM/TC) of an aqueous medium (AM) to toner components (TC) in the dispersion is generally from 50/100 to 2,000/100, and preferably from 100/100 to 1,000/100. When the weight ratio is less than 50/100, the toner components are not satisfactorily dispersed. By contrast, adding an aqueous medium in an amount of 2,000 parts by weight based on 100 parts by weight of the toner components is not economical.

When a toner component liquid is dispersed in an aqueous medium, it is preferable to preliminarily disperse an inorganic dispersant or a particulate resin in the aqueous medium so that the resultant toner particles have a narrow particle diameter distribution. Specific examples of such an inorganic dispersant include tricalcium phosphate, calcium carbonate, titanium oxide, colloidal silica and hydroxyapatite.

Suitable resins for use as the particulate resin include known resins which can form an aqueous resin dispersion.

Specific examples of such resins include thermoplastic and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins and polyester resins are preferably used because an aqueous dispersion including fine spherical resin particles can be easily prepared.

The method for preparing an aqueous resin dispersion is not particularly limited. Specific examples of the method are as follows.

(a) A method in which one or more vinyl monomers are polymerized using a method such as suspension polymerization methods, emulsion polymerization methods, seed polymerization methods and dispersion polymerization to directly prepare an aqueous dispersion of a vinyl resin;

(b) A method in which a precursor (monomer or oligomer) of a polyaddition type resin or a polycondensation type resin such as polyester resins, polyurethane resins and epoxy resins or a solution of the precursor is dispersed in an aqueous medium in the presence of a proper dispersant, and the dispersion is heated or mixed with a crosslinking agent to polymerize and crosslink the precursor, resulting in preparation of an aqueous dispersion of the resin;

(c) A method in which a precursor (monomer or oligomer) of a polyaddition type resin or a polycondensation type resin such as polyester resins, polyurethane resins and epoxy resins or a solution of the precursor (or a melted precursor) is mixed with an emulsifier and then water is added thereto to perform phase inversion, followed by polymerization, resulting in preparation of an aqueous dispersion of the resin;

(d) A method in which a resin prepared by a polymerization method such as addition polymerization, ring-opening polymerization, polyaddition reaction, addition condensation and polycondensation polymerization is pulverized with a pulverizer such as mechanical rotation pulverizers and jet air pulverizers, followed by classification, to prepare a particulate resin, and the particulate resin is dispersed in water using a proper dispersant to prepare an aqueous dispersion of the particulate resin;

(e) A method in which a resin prepared by a polymerization method such as addition polymerization, ring-opening polymerization, polyaddition reaction, addition condensation and polycondensation polymerization is dissolved in a solvent, followed by spraying of the solution to prepare a particulate resin, and the particulate resin is dispersed in water using a proper dispersant to prepare an aqueous dispersion of the particulate resin;

(f) A method in which a resin prepared by a polymerization method such as addition polymerization, ring-opening polymerization, polyaddition reaction, addition condensation and polycondensation polymerization is dissolved in a solvent to prepare a resin solution; the resin solution is mixed with a solvent which cannot dissolve the resin, or the solution is cooled, to precipitate particles of the resin therein; the particulate resin is separated from the solvent; and then the particulate resin is dispersed in water using a proper dispersant to prepare an aqueous dispersion of the resin;

(g) A method in which a resin prepared by a polymerization method such as addition polymerization, ring-opening polymerization, polyaddition reaction, addition condensation and polycondensation polymerization is dissolved in a solvent, and the solution is dispersed in an aqueous medium using a proper dispersant, followed by removal of the solvent, to prepare an aqueous dispersion of the resin; and (h) A method in which a resin prepared by a polymerization method such as addition polymerization, ring-opening polymerization, polyaddition reaction, addition condensation and polycondensation polymerization is dissolved in a solvent, the solution is mixed with an emulsifier, and then water is added thereto to perform phase inversion, followed by removal of the solvent, to prepare an aqueous dispersion of the resin.

In order to stabilize drops of the toner component liquid in an aqueous medium and to prepare toner particles having a desired particle form and a sharp particle diameter distribution in the dispersion, the aqueous medium preferably includes a dispersant. Suitable materials for use as the dispersant include surfactants, inorganic dispersants which are hardly soluble in water, polymer protection colloids, etc. These dispersants can be used alone or in combination.

Suitable surfactants for use as dispersants include anionic surfactants, cationic surfactants, nonionic surfactants, and ampholytic surfactants.

Suitable anionic surfactants include alkylbenzene sulfonic acid salts, α-olefin sulfonic acid salts, and phosphoric acid salts.

Suitable cationic surfactants include amine salt based surfactants and quaternary ammonium salt based surfactants. Specific examples of the amine salt based surfactants include alkyl amine salts, aminoalcohol fatty acid derivatives, polyamine fatty acid derivatives, and imidazoline.

Specific examples of the quaternary ammonium salt based surfactants include alkyltrimethyl ammonium salts, dialkyldimethyl ammonium salts, alkyldimethyl benzyl ammonium salts, pyridinium salts, alkyl isoquinolinium salts, and benzethonium chloride.

Suitable nonionic surfactants include fatty acid amide derivatives, and polyhydric alcohol derivatives.

Suitable ampholytic surfactants include alanine, dodecyldi(aminoethyl)glycin, di(octylaminoethyle)glycin, and N-alkyl-N,N-dimethylammonium betaine.

It is preferable to use a surfactant having a fluoroalkyl group because a good dispersing effect can be produced even when the added amount is small. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl (C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the cationic surfactants having a fluoroalkyl group include primary, secondary and tertiary aliphatic amino acids having a fluoroalkyl group, perfluoroalkyl (C6-C10)sulfoneamidepropyltrimethylammonium salts, benzalkonium salts, benzetonium chloride, pyridinium salts, imidazolinium salts, etc.

The toner component liquid can be satisfactorily dispersed in an aqueous medium using a polymer protection colloid.

Suitable polymer protection colloids include homopolymers and copolymers of acid monomers, (meth)acrylic monomers having a hydroxyl group, vinyl alcohol and ethers of vinyl alcohol, esters of vinyl alcohol and compounds having a carboxyl group, amides and methylol compounds thereof, acid chlorides, and monomers having a nitrogen atom or a heterocyclic ring including a nitrogen atom; polyoxyethylene resins; and cellulose compounds.

Specific examples of the acid monomers include acrylic acid, methacrylic acid, α-cyanoacrylic acid, α-cyanomethacrylic acid, itaconic acid, crotonic acid, fumaric acid, maleic acid, and maleic anhydride.

Specific examples of the acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide, and N-methylolmethacrylamide.

Specific examples of the ethers of vinyl alcohol include vinyl methyl ether, vinyl ethyl ether, and vinyl propyl ether.

Specific examples of the esters of vinyl alcohol with a compound having a carboxyl group include vinyl acetate, vinyl propionate, and vinyl butyrate.

Specific examples of the acrylic amides include acrylamide, methacrylamide, and diacetoneacrylamide.

Specific examples of the acid chlorides include acrylic acid chloride, and methacrylic acid chloride.

Specific examples of the monomers having a nitrogen atom or a heterocyclic ring having a nitrogen atom include vinyl pyridine, vinyl pyrrolidone, vinyl imidazole, and ethylene imine.

Specific examples of the polyoxyethylene resins include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific examples of the cellulose compounds include methyl cellulose, hydroxyethyl cellulose, and hydroxypropyl cellulose.

When a compound such as calcium phosphate, which is soluble in an acid or alkali are used as a dispersion stabilizer, the resultant toner particles are preferably mixed with an acid such as hydrochloric acid, followed by washing with water to remove calcium phosphate from the toner particles. In addition, calcium phosphate can be removed using a zymolytic method.

When a dispersant is used, the resultant toner particles are preferably washed after the prepolymer in the toner component liquid is subjected to a polymer chain growth reaction and/or a crosslinking reaction to impart good chargeability to the toner particles.

The method for dispersing a toner component liquid in an aqueous medium is not particularly limited, and known dispersing methods such as low speed shearing methods, high speed shearing methods, friction methods, high pressure jet air methods, and ultrasonic methods. Among these dispersing methods, high-speed shearing methods are preferably used to prepare a dispersion in which particles having an average particle diameter of from 2 μm to 20 μm are dispersed. When a high speed shearing type dispersing machine is used, the revolution of the rotor of the dispersing machine is generally from 1,000 rpm to 30,000 rpm, and preferably from 5,000 rpm to 20,000 rpm. The dispersing time is not particularly limited, but when a batch dispersing machine is used, the dispersing time is generally from 0.1 minutes to 5 minutes. When the toner component liquid is dispersed in an aqueous medium, the temperature of the emulsion is generally from 0° C. to 150° C. (under pressure), and preferably from 20° C. to 80° C.

In order to remove an organic solvent from the thus-prepared emulsion (i.e., toner particle dispersion), a method in which the emulsion is gradually heated to perfectly evaporate the organic solvent included in the drops of the oil phase liquid (toner component liquid) can be used. Alternatively, a method in which the emulsion is sprayed in a dry environment to dry the organic solvent in the drops of the oil phase liquid, and the aqueous medium and surfactant included in the emulsion, resulting in formation of toner particles, can be used. Specific examples of such a dry environment include gases of air, nitrogen, carbon dioxide, combustion gas, etc., which are preferably heated to a temperature not lower than the boiling point of the solvent having the highest boiling point among the solvents used in the emulsion or dispersion. Toner particles having desired properties can be rapidly prepared by performing this treatment using a spray dryer, a belt dryer, a rotary kiln, or the like.

An amine (B) to be reacted with a prepolymer (A) is included in an organic solvent in which the toner components are to be dissolved or dispersed, or an aqueous medium to which a toner component liquid is to be added.

A prepolymer (A) included in a toner component liquid is reacted with an amine (B) included in the toner component liquid or an aqueous medium. The reaction time is determined depending on the reactivity of the prepolymer with the amine, and is generally from 1 minute to 40 hours, and preferably from 1 hour to 24 hours. The reaction temperature is generally from 0° C. to 150° C., and preferably from 20° C. to 98° C. Known catalysts can be used for the reaction, if desired.

The thus-prepared toner particle dispersion is then subjected to a washing treatment and a drying treatment using known methods. Specifically, after the dispersion is subjected to a solid-liquid separation treatment using a centrifugal separation machine or a filter press, the resultant toner particle cake is dispersed again in ion-exchange water, which optionally includes an acid or an alkali, at a temperature of from room temperature to 40° C. to be washed, followed by a solid-liquid separation treatment. The series of treatments are repeated several times to remove impurities and surfactants. Next, the prepared wet cake is dried using a dryer such as a flash dryer, a circulation dryer, a reduced-pressure dryer, a vibration dryer, etc. Thus, a colored particulate material (i.e., toner particles, or mother toner) can be prepared. In this case, fine toner particles may be removed therefrom using a centrifugal separation machine, and the particle diameter distribution of the toner particles may be adjusted using a classifier after drying the toner particles.

The thus-prepared toner particles are mixed with a particulate crystalline hydroxyapatite serving as an external additive so that the particulate crystalline hydroxyapatite is present on a surface of the toner particles. In this regard, crystalline hydroxyapatites having an aspect ratio of not less than 3 and less than 30 are preferably used. Among these hydroxyapatites, rod-shaped or needle-shaped hydroxyapatites having an aspect ratio of not less than 15 and less than 30 and a volume average primary particle diameter of from 8 nm to 35 nm, and plate-shaped hydroxyapatites having an aspect ratio of not less than 3 and less than 15 and a volume average primary particle diameter of from 8 nm to 250 nm are preferable.

Another external additive can be used for preparing the toner of the present invention. The added amount of such an external additive is less than 50% by weight, and preferably not greater than 33.3%, based on the total weight of the external additives used so that the above-mentioned effect of the present invention is not weakened. Specific examples of such an external additive include silica, titanium compounds, alumina, cerium oxide, calcium carbonate, magnesium carbonate, calcium phosphate, particulate fluorine-containing resins, particulate silicon-containing resins, particulate nitrogen-containing resins, etc. Among the titanium compounds, titanium compounds, which are prepared by reacting at least part of $TiO(OH)_2$, which is prepared by a wet method, with a silane compound or a silicone oil, are preferable.

The shape of a crystalline hydroxyapatite can be controlled by adjusting the preparation method. Specific examples of the methods for preparing a crystalline hydroxyapatite having a rod- or needle-form or a plate-form include known methods such as (a) sintering methods in which a precipitation or a product is sintered; (b) precipitation methods in which, while sublimation is performed for a long period of time, a crystalline hydroxyapatite is precipitated at a temperature of from 70° C. to 100° C.; (c) hydrothermal reaction methods; and (d) solid-state diffusion methods.

References to the methods (a)-(d) are as follows.

(a) Sintering Methods (i) Hayek E, Newesely H: Pentacalcium monohydroxyorthophosphate. Inorga Synth 1963; 7:63;

(ii) Jarcho M: Calcium phosphate ceramics as hard tissue replacements. Clin Orthop 1963; 7 63; and (iii) Lehr J R, Brown E H, Frazier A w, Smith J P, Thrasher R D: Crystallographic properties of fertilizer compounds. TVA Chem Engr Bull, National Fertilizer Development Center, Muscle Shoals, Ala., 1967, No. 6.

(b) Precipitation Methods (iv) Featherstone J D B, Shields C P, Kademazad B, Oldershaw M D: Acid reactivity of carbonate apatite with strontium and fluoride substitution. J Dent Res 1983; 62; 1049-1053;

(v) LeGeros R Z: Crystallographic studies of the carbonate substitution in the apatite structure; PhD thesis, New York University, 1967;

(vi) LeGeros R Z: Apatites form aqueous and non-aqueous systems: Relation to biological apatites. Proc 1$^{st}$ Int Congr on Phosphorous Compounds (IMPHOS), Rabat, Morocco, 1977, pp 347-360;

(vii) LeGeros R Z, Tung M S: Chemical stability of carbonate- and fluoride-containing apatites. Caries Res 1983; 17; 419-429;

(viii) LeGeros R Z, Trautz O R, Legoros R Z, Klein E: Carbonate substitution in the apatite structure. I Bull soc Chim 1968: 1712-1718;

(ix) LeGeros R Z, Taheri M H, Quirolgico G, LeGeros J R: Formation and stability of apatites: Effects of some cationic substituents. Pro 2$^{nd}$ Int Congr on phosphorous Compounds, Boston 1980. pp 89-103; and (x) Nancollas G H, Mohan M S: The growth of calcium phosphate on hydroxyapatite crystals, Effect of supersaturation and ionic medium. J Phys Chem 1974; 78: 2218-2225.

(c) Hydrothermal Reaction Methods (xi) Klein E, LeGeros J R, Trautz O R, LeGoros R Z: Polarized infrared reflectance of single crystals of apatites. Dev. Appl Spectrose 1970; 7B 3-12;

(xii) LeGores R Z: Crystallographic studies of the carbonate substitution in the apatite structure; PhD Res 1986; 1; 425-432; and (xiii) Terpstra R A: Theremodynamic stability and crystal morphology of some calcium phosphates; PhD thesis, University of Nijmegen, 1985.

(d) Solid-State Diffusion Methods (xiv) Lee D S, Landis W J, Glimcher M J: The solid, calcium-phosphate mineral phases in embryonic chick bone characterized by high-voltage electron diffraction. J Bone Miner Res 1986; 1; 425-432; and the above-mentioned reference (xiii).

For example, a crystalline hydroxyapatite can be prepared by dropping an aqueous solution of a water-soluble phosphate into a strongly-basic aqueous solution of a calcium salt, which is prepared by dissolving a water-soluble calcium salt in water, washing the resultant precipitate, and then subjecting the precipitate to calcination or heated-air drying. Alternatively, in the above-mentioned dropping step, an aqueous solution of a calcium salt may be dropped into an aqueous solution of a soluble phosphate, or an aqueous solution of a calcium salt and an aqueous solution of a water-soluble phosphate may be dropped into a basic water. In this regard, volatile or decomposable materials such as ammoniums and amines are preferably used as counter cations of soluble phosphates to prevent increase in content of impurities in the product. In addition, volatile acids such as nitric acid and acetic acid are preferably used as anions of calcium salts.

They say that pure hydroxyapatite $Ca_{10}(PO_4)_6(OH)_2$ can be prepared from an aqueous reaction system only under a basic condition (i.e., pH<11) similarly to pure β-tricalcium-phosphate, and in addition it is necessary to subject a precipitate to calcination at a temperature of not lower than 900° C. or a hot water treatment at a temperature of not lower than 375° C. By changing the reaction conditions, the formula and crystal form of the product (i.e., hydroxyapatite compounds) can be changed. These hydroxyapatite compounds can be preferably used for the toner of the present invention.

For example, hydroxyapatite compounds, in which the atomic ratio of Ca to P is slightly lower than the theoretical ratio (Ca/P=1.67), i.e., in which all the hydrogen atoms of phosphoric acid are not substituted by Ca, and several phosphoric acid groups remain, can be prepared under a weaker basic condition, i.e., at a pH lower than 11. Such hydroxyapatite compounds, which are not pure hydroxyapatite, can be used for the toner of the present invention more preferably than pure hydroxyapatite. In addition, finer hydroxyapatite compounds can be prepared by using a basic reaction liquid including water and a water soluble organic solvent such as methanol while agitating the liquid. This is because precipitation of the product can be accelerated.

As mentioned above, an external additive (other than hydroxyapatite) can be added to a colored particulate material (toner particles) to improve the fluidity, preservability, developing property and transferability of the toner.

Suitable mixers for use in mixing an external additive and toner particles include known mixers for use in mixing powders, which preferably have a jacket to control the inside temperature thereof. It is possible to change the mixing conditions such as rotation speed and rolling speed of the mixer, mixing time, and mixing temperature, to change the stress on the external additive. In addition, a mixing method in which initially a relatively high stress is applied and then a relatively low stress is applied to the external additive, or vice versa; a method in which an external additive is gradually added to a colored particulate material while mixing the mixture; or a method in which initially a colored particulate material is agitated by a mixer for a predetermined period of time and then an external additive is added to the agitated colored particulate material, can also be used.

Specific examples of the mixers include V-form mixers, locking mixers, LOEDGE MIXER, NAUTER MIXER, HENSCHEL MIXER and the like mixers.

The developer of the present invention is a one-component developer consisting essentially of the toner of the present invention or a two-component developer including the toner of the present invention and a carrier. When the developer is used for high-speed image forming apparatus, a two-component developer is preferably used because of having a relatively long life. The weight ratio (T/C) of the toner of the present invention to a carrier in a two-component developer is preferably from 1/100 to 10/100.

When the toner of the present invention is used as a one component developer while a fresh toner is supplied, the particle diameter distribution of the toner hardly changes even when the toner is used while agitated in a developing device for a long period of time, and therefore toner images having good image qualities can be reliably produced for a long period of time without causing problems such that a film of the toner is formed on a developing roller, and the toner adheres to a toner layer forming member (such as blades).

In addition, when a two component developer including the toner of the present invention and a carrier is used for a long period of time while a fresh toner is supplied, the particle diameter distribution of the toner in the developer hardly changes even if the developer is agitated for a long period of time in a developing device, and therefore toner images having good image qualities can be reliably produced.

The carrier for use in the two component developer of the present invention is not particularly limited, and one or more proper carrier materials are selected from known carrier materials so that the resultant developer meets the purpose. However, it is preferable to use a coated carrier which includes a core material coated with a resin.

Suitable materials for use as the core material include manganese-strontium materials and manganese-magnesium materials, which have a saturation magnetization of from 50 $Am^2/kg$ to 90 $Am^2/kg$ (50 emu/g to 90 emu/g). In view of image density, high magnetization materials such as iron powders (having a saturation magnetization of not less than 100 $Am^2/kg$ (100 emu/g) and magnetite having a saturation magnetization of from 75 $Am^2/kg$ to 120 $Am^2/kg$ (75 emu/g to 120 emu/g) are preferably used. In addition, low magnetization materials such as copper-zinc materials having a saturation magnetization of from 30 $Am^2/kg$ to 80 $Am^2/kg$ (30 emu/g to 80 emu/g) can also be preferably used because impact of a magnetic brush thereof against a photoreceptor is relatively weak and therefore high quality images can be produced.

These carrier materials can be used alone or in combination.

The core material of a carrier for use in a two-component developer of the present invention preferably has a weight average particle diameter of from 10 μm to 200 μm, and more preferably from 40 μm to 100 μm. When the weight average particle diameter is smaller than 10 μm, (i.e., the content of fine carrier particles increases), the magnetization per each particle decreases, resulting in occurrence of a carrier scattering problem. By contrast, when the weight average particle diameter is larger than 200 μm, the surface area of the carrier per unit of weight decreases, thereby insufficiently charging the toner, resulting in occurrence of a toner scattering problem. In addition, uneven images tend to be formed particularly when full color images having a large solid image are produced.

Specific examples of resins for use in covering the surface of carriers include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, silicone resins, epoxy resins, etc. These resins can be used alone or in combination.

Specific examples of such amino resins include urea-formaldehyde resins, melamine resins, benzoguanamine resins, urea resins, and polyamide resins. Specific examples of the vinyl or vinylidene resins include acrylic resins, polymethylmethacrylate resins, polyacrylonitirile resins, polyvinyl acetate resins, polyvinyl alcohol resins, and polyvinyl butyral resins. Specific examples of the polystyrene resins include polystyrene resins, and styrene-acrylic copolymers. Specific examples of the halogenated olefin resins include polyvinyl chloride resins. Specific examples of the polyester resins include polyethylene terephthalate resins, and polybutylene terephthalate resins.

If desired, an electroconductive powder can be included in the resin layer of the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is larger than 1 μm, it becomes hard to control the electric resistance of the resin layer.

The cover layer can be formed by coating a resin solution, which is prepared by dissolving a resin in a solvent, on a core material using any known coating method, followed by drying and baking. Suitable coating methods include dip coating methods, spray coating methods, brush coating methods, etc.

Specific examples of the solvent for use in the coating liquid include toluene, xylene, methyl ethyl ketone, methyl isobutyl ketone, methyl cellosolve, butyl acetate, etc.

The method of baking the coated cover layer is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The weight ratio of the cover layer to the coated carrier is preferably 1/10,000 (0.01%) to 5/100 (5.0%). When the weight ratio is less than 1/10,000, a uniform cover layer cannot be formed. When the weight ratio is greater than 5/100, the carrier particles tend to aggregate, thereby unevenly charging the toner, resulting in decrease in image quality.

The developer of the present invention can be preferably used for known developing methods such as magnetic one-component developing methods, non-magnetic one-component developing methods, and two-component developing methods.

The process cartridge of the present invention includes at least an image bearing member on which an electrostatic latent image is formed, and a developing device configured to develop the electrostatic latent image with the developer of the present invention to form a toner image on the image bearing member, wherein the image bearing member and the developing device are integrated into a single unit. The process cartridge can include one or more other devices such as charging devices, cleaning devices, and transferring devices.

FIGURE illustrates an example of the process cartridge of the present invention. The process cartridge includes a photoreceptor 10 serving as an image bearing member, a charger 20 configured to charge the photoreceptor, a developing device 40 configured to develop an electrostatic latent image, which is formed by irradiating the photoreceptor with light L emitted by an irradiating device 30, with the developer of the present invention to form a toner image on the photoreceptor, a transferring device 50 configured to transfer the toner image onto a recording sheet S, and a cleaner 60 configured to clean the surface of the photoreceptor after the toner image is transferred. These devices are the same as those used for the image forming apparatus mentioned below.

The image forming method of the present invention includes at least a step of forming an electrostatic latent image on an image bearing member; a step of developing the electrostatic latent image with the developer of the present invention to form a toner image on the image bearing member; and a step of transferring the toner image onto the recording sheet S. The image forming method can optionally include other steps such as a fixing step of fixing the toner image on a recording material, a discharging step of discharging the image bearing member to decay residual charges thereon, a cleaning step of cleaning the surface of the image bearing member, a recycling step of returning the toner particles collected by the cleaner to the developing device to be reused, and a controlling step of controlling all of the steps mentioned above.

The image forming apparatus for use in the present invention includes at least a photoreceptor serving as an image bearing member, a charging device configured to charge the photoreceptor, an irradiating device configured to irradiate the charged photoreceptor with light to form an electrostatic latent image on the photoreceptor, a developing device configured to develop the electrostatic latent image with the developer of the present invention to form a toner image on the photoreceptor, and a transferring device configured to transfer the toner image onto a recording material. The image forming apparatus can further include a fixing device configured to fix the toner image onto the recording material, a discharging device configured to discharge residual charges remaining on the photoreceptor, a cleaning device configured to clean the surface of the photoreceptor, a recycling device configured to return the toner particles collected by the cleaner to the developing device to reuse the toner, and a controller configured to control the operations of these devices.

In the latent image forming process, an electrostatic latent image is formed on a photoreceptor serving as an image bearing member, for example, by evenly charging the surface of the photoreceptor using a charger, and then irradiating the charged photoreceptor with light using an irradiating device.

The photoreceptor for use in the present invention is not particularly limited with respect to the constituent materials, shape, size, etc. Namely, known photoreceptors can be used. With respect to the shape of photoreceptors, drum-shaped photoreceptors are preferably used. With respect to the photosensitive material, inorganic photosensitive materials (e.g., amorphous silicon and selenium) and organic photosensitive materials (e.g., polysilane, and phthalopolymethine) can be used. Among these photosensitive materials, amorphous silicon is preferably used because of having long life.

The charger for use in the present invention is not particularly limited, and known chargers can be used. Specific examples thereof include contact chargers having a conductive or semi-conductive charging element such as rollers, brushes, films and rubber blades; and non-contact chargers such as corotrons and scorotrons.

Among the chargers, contact or non-contact chargers applying a combination of a DC voltage and an AC voltage to the photoreceptor can be preferably used. More preferably, short-range chargers including a charging roller, in which a tape is wound around each end portion thereof so as to be contacted with the surface of a photoreceptor to form a predetermined gap between the surface of the charging roller and the surface of the photoreceptor and which applies a combination of a DC voltage and an AC voltage to the photoreceptor, can be used. In this case, the surface of the photoreceptor can be evenly charged.

Any known irradiation devices can be used for the present invention as long as the devices can irradiate the charged photoreceptor with imagewise light. Specific examples thereof include optical systems for use in copiers; optical systems using rod lens arrays; optical systems using laser; and optical systems using a liquid crystal shutter. Although light L irradiates from a front side of the photoreceptor 10 in FIGURE, the irradiating method is not limited thereto, and it is possible to irradiate the charged photoreceptor from a backside of the photoreceptor.

In the developing process, the electrostatic latent image formed on the photoreceptor is developed with the above-mentioned developer of the present invention using a developing device to form a visible image on the photoreceptor.

Known developing devices can be used for the present invention as long as the toner (or the developer) of the present invention can be used therefor. For example, developing devices containing the developer therein and having a developer bearing member which supplies the toner to an electrostatic latent image on the photoreceptor while contacting or not contacting the photoreceptor can be used. The developing device preferably has a toner container, which contains the toner of the present invention as a supplementary toner and which is detachably attached to the developing device (or image forming apparatus).

The developing device is a dry developing device which includes one or more developing sections for developing monochrome images or multi-color images. The developing device includes an agitator configured to agitate the developer to charge the toner, and a developer bearing member (such as rotatable magnet rollers) bearing the developer to supply the toner to the photoreceptor.

In the developing device, the toner of the present invention and a carrier are agitated so that the toner is charged. The toner and carrier are then fed to the developer bearing member (magnetic roller) and form a magnetic brush on the surface of the developer bearing member. Since the developer bearing member is located closely to the photoreceptor, the toner contained in the magnetic brush is electrostatically attracted by an electrostatic latent image on the surface of the photoreceptor, resulting in transferring of the toner to the latent image. Thus, the electrostatic latent image is developed with the toner, resulting in formation of a toner image on the surface of the photoreceptor. In order to efficiently transfer the toner to the surface of the photoreceptor, an alternating electric field is preferably applied to the developer bearing member.

In the transferring process, it is preferable that the toner image formed on the photoreceptor is primarily transferred to an intermediate transfer medium (primary transfer process), and the toner image is then transferred to a recording material (secondary transfer process). When multiple color images and full color images are formed using two or more color toners, it is preferable that plural color toner images are transferred to an intermediate transfer medium one by one (primary transfer process), and the plural toner images (i.e., a combined color toner image) on the intermediate transfer medium are transferred to a recording material at the same time (secondary transfer process).

The transfer device preferably has a primary transfer device configured to transfer one or more toner images on multiple image bearing members to an intermediate transfer medium to form a monochrome toner image or a combined color toner image on the intermediate transfer medium, and a secondary transfer device configured to transfer the monochrome toner image or a combined color toner image onto a recording material.

The transfer device preferably has a transferring member configured to charge the toner image so as to be easily transferred onto a recording material or an intermediate transfer medium.

The transfer device includes one or more transferring member such as corona dischargers, transfer belts, transfer rollers, pressure transfer rollers, and adhesive transferring members.

The intermediate transfer medium for use in the image forming apparatus is not particularly limited, and any known intermediate transfer media can be used. Specific examples thereof include belt-form intermediate transfer media.

The recording material is not particularly limited with respect to constituent materials, size, physical properties, etc., and known recording materials such as paper sheets can be used.

In the fixing process, the toner image transferred to a recording material is fixed thereto using a fixing device. When multiple toner images are transferred, the fixing operation can be performed on each toner image whenever the toner image is transferred on a recording material, or on all the toner images at the same time after all the toner images are transferred on a recording material.

The fixing device is not particularly limited, and a proper fixing device suitable for the image forming apparatus is chosen. Suitable fixing devices include heat fixing devices which heat toner images while applying a pressure thereto, and suitable fixing members include rollers and belts. Specific examples of such heat fixing members include combinations of a heat roller and a pressure roller, and combinations of a heat roller, a pressure roller and an endless belt.

When such heat fixing devices are used, the fixing temperature is preferably from 80° C. to 200° C.

Specific examples of such a fixing device including a combination of a heat roller, a pressure roller and an endless belt include fixing devices which include a heating member equipped with a heater, a film contacted with the heating member, and a pressing member contacted with the heating member with the film therebetween, wherein a toner image on a recording material is sandwiched by the film and the pressing member to be fixed to the recording material.

A light fixing device configured to fix a toner image with light can be used alone or in combination of a heat fixing device as the fixing device.

In the discharging process, charges remaining on the photoreceptor even after a toner image is transferred from the photoreceptor to a recording material are decayed by applying a discharging bias to the photoreceptor or irradiating the photoreceptor with light, using a discharging device.

Known discharging devices can be used. Specific examples thereof include discharging (quenching) lamps.

In the cleaning process, particles of the toner, which remain on the surface of the photoreceptor even after a toner image thereon is transferred onto a recording material, are removed therefrom using a cleaning device.

Known cleaners can be used for the cleaning device. Specific examples thereof include magnetic brush cleaners, electrostatic brush cleaners, magnetic roller cleaners, blade cleaners, brush cleaners, and web cleaners.

In the toner recycling process, particles of the toner collected by the cleaning device are returned to the developing device using a recycling device to be reused for developing electrostatic latent images.

Known powder feeding devices can be used as the recycling device.

In the controlling process, the above-mentioned processes (devices) are controlled by a controller. The controller is not particularly limited, and known controllers such as sequencers and computers can be used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

I. Preparation of Toner Using Wet Method

1. Synthesis of Particulate Resin Dispersion

In a reaction vessel equipped with an agitator and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were mixed. The mixture was agitated for 15 minutes while the agitator was rotated at a revolution of 400 rpm. As a result, a white emulsion was prepared. The emulsion was then heated to 75° C. and the temperature was maintained for 5 hours to react the monomers.

Further, 30 parts of a 1% aqueous solution of ammonium persulfate was added thereto, and the mixture was aged for 5 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid) was prepared. This dispersion is hereinafter referred to as a particulate resin dispersion (1).

The weight average particle diameter of the resin particles in the particulate resin dispersion (1) was 105 nm. Part of the particulate resin dispersion (1) was heated to solidify the resin. The glass transition temperature (Tg) and the weight average molecular weight (Mw) of the resin were 59° C. and 150,000, respectively.

2. Preparation of Aqueous Phase Liquid

The following components were mixed in a vessel using a mixer.

| | |
|---|---|
| Water | 990 parts |
| Particulate resin dispersion (1) | 83 parts |
| Sodium salt of dodecyl diphenyl ether disulfonic acid (ELEMINOL MON-7 from Sanyo Chemical Industries Ltd., solid content of 48.5%) | 37 parts |
| Ethyl acetate | 90 parts |

Thus, an aqueous phase liquid (1), which is a milk white liquid, was prepared.

3. Preparation of Low Molecular Weight Polyester Resin

The following components were contained in a reaction vessel equipped with a condenser, an agitator and a nitrogen feed pipe to perform a polycondensation reaction for 8 hours at 230° C. under normal pressure.

| | |
|---|---|
| Ethylene oxide adduct (2 mole) of bisphenol A | 229 parts |
| Propylene oxide adduct (3 mole) of bisphenol A | 529 parts |
| Terephthalic acid | 208 parts |
| Adipic acid | 46 parts |
| Dibutyl tin oxide | 2 parts |

The reaction was further continued for 5 hours under a reduced pressure of from 10 mmHg to 15 mmHg (1.33 Pa to 2.00 Pa). Next, 44 parts of trimellitic anhydride was added thereto and the mixture was reacted for 2 hours at 180° C. under normal pressure. Thus, a low molecular weight polyester resin (1) was prepared.

It was confirmed that the low molecular weight polyester resin (1) has a number average molecular weight (Mn) of 2,500, a weight average molecular weight (Mw) of 6,700, a glass transition temperature (Tg) of 43° C., and an acid value of 25 mgKOH/g.

4. Preparation of Intermediate Polyester and Prepolymer

The following components were contained in a reaction vessel equipped with a condenser, an agitator and a nitrogen feed pipe to be reacted for 8 hours at 230° C. under normal pressure.

| | |
|---|---|
| Ethylene oxide adduct (2 mole) of bisphenol A | 682 parts |
| Propylene oxide adduct (3 mole) of bisphenol A | 81 parts |
| Terephthalic acid | 283 parts |
| Trimellitic anhydride | 22 parts |
| Dibutyl tin oxide | 2 parts |

The reaction was further continued for 5 hours under a reduced pressure of from 10 mmHg to 15 mmHg (1.33 Pa to 2.00 Pa).

Thus, an intermediate polyester (1) was prepared.

It was confirmed that the intermediate polyester (1) has a number average molecular weight of 2,100, a weight average molecular weight (Mw) of 9,500, a glass transition temperature (Tg) of 55° C., an acid value of 0.5 mgKOH/g, and a hydroxyl value of 51 mgKOH/g.

Next, the following components were contained in a reaction vessel equipped with a condenser, an agitator and a nitrogen feed pipe to be reacted for 5 hours at 100° C.

| | |
|---|---|
| Intermediate polyester (1) | 410 parts |
| Isophorone diisocyanate | 89 parts |
| Ethyl acetate | 500 parts |

Thus, a polyester prepolymer (1) having an isocyanate group was prepared. The content of free isocyanate therein was 1.53% by weight.

5. Preparation of Ketimine Compound

In a reaction vessel equipped with an agitator and a thermometer, 170 parts of isophorone diamine and 75 parts of methyl ethyl ketone were mixed and reacted for 5 hours at 50° C. to prepare a ketimine compound (1). It was confirmed that the ketimine compound (1) has an amine value of 418 mgKOH/g.

6. Preparation of Master Batch

The following components were mixed with a HENSCHEL MIXER mixer.

| | |
|---|---|
| Water | 35 parts |
| Phthalocyanine pigment (FG7351 from Toyo Ink Mfg. Co., Ltd.) | 40 parts |
| Polyester resin (RS801 from Sanyo Chemical Industries Ltd.) | 60 parts |

The mixture was kneaded with a two-roll mill for 30 minutes at 150° C., followed by roll cooling and pulverization using a pulverizer. Thus, a master batch (1) was prepared.

7. Preparation of Oil Phase Liquid (1) Preparation of Organic Solvent Liquid

The following components were contained in a reaction vessel equipped with an agitator and a thermometer.

| | |
|---|---|
| Low molecular weight polyester resin (1) | 378 parts |
| Carnauba wax | 110 parts |
| Charge controlling agent | 22 parts |

-continued

| | |
|---|---|
| (Salicylic acid metal complex E-84 from Orient Chemical Co., Ltd.) | |
| Ethyl acetate | 947 parts |

The mixture was heated to 80° C. while agitated. After being agitated for 5 hours at 80° C., the mixture was cooled to 30° C. over one hour.

Next, 500 parts of the master batch (1) and 500 parts of ethyl acetate were added thereto and the mixture was agitated for one hour. Thus, a toner component solution (1) was prepared.

Further, 1,324 parts of the toner component solution (1) was subjected to a dispersion treatment using a bead mill (ULTRAVISCOMILL from Aimex Co., Ltd.) to disperse the phthalocyanine pigment and carnauba wax. The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 1,324 parts of a 65% ethyl acetate solution of the low molecular weight polyester resin (1) was added thereto. The mixture was subjected to a dispersion treatment using the bead mill. The dispersion conditions are the same as those mentioned above except that the dispersion operation was performed once (i.e., one pass).

Thus, a pigment/wax dispersion (1) was prepared. The solid content of the pigment/wax dispersion (1), which was determined by heating the dispersion for 30 minutes at 130° C., was 50% by weight.

(2) Preparation of Oil Phase Liquid

The following components were contained in a vessel.

| | |
|---|---|
| Pigment/wax dispersion (1) | 648 parts |
| Prepolymer (1) | 154 parts |
| Ketimine compound (1) | 6.6 parts |

The components were mixed for 1 minute using a TK HOMOMIXER mixer from Tokushu Kika Kogyo K.K., whose rotor was rotated at a revolution of 5,000 rpm. Thus, an oil phase liquid (1) was prepared.

8. Preparation of Shape-Controlled Emulsion (1) Preparation of Emulsion (1)

The following components were mixed for 20 minutes in a vessel using a TK HOMOMIXER mixer, whose rotor was rotated at a revolution of 13,000 rpm, to prepare an emulsion (1).

| | |
|---|---|
| Oil phase liquid (1) | 808.6 parts |
| Aqueous phase liquid (1) | 1,200 parts |

(2) Preparation of Shape-Controlled Emulsion

Initially, 3.15 parts of a CMC (CELLOGEN BS-H from Dai-ichi Kogyo Seiyaku Co., Ltd.) was gradually added to 75.6 parts of ion-exchange water, which was agitated with a TK HOMOMIXER mixer at a revolution of 2,000 rpm. After addition of the CMC was completed, the CMC solution was agitated by the TK HOMOMIXER mixer for 30 minute at 20° C.

Next, 43.3 parts of a sodium salt of dodecyl diphenyl ether disulfonic acid (ELEMINOL MON-7 from Sanyo Chemical Industries Ltd., solid content of 48.5%) was added to the CMC solution prepared above, and the mixture was agitated for 5 minutes at 20° C. Further, 2,000 parts of the emulsion (1) prepared above was added to the mixture, and the mixture was agitated for 1 hour using a TK HOMOMIXER mixer at a revolution of 2,000 rpm.

Thus, a shape-controlled emulsion (1) was prepared.

9. Preparation of Colored Particulate Material (Toner Particles, or Mother Toner)

(1) Solvent Removal

The shape-controlled emulsion (1) was contained in a vessel equipped with an agitator and a thermometer, and heated for 8 hours at 30° C. to remove the organic solvent (i.e., ethyl acetate), followed by aging for 4 hours at 45° C. Thus, a colored particulate material dispersion (1) was prepared.

(2) Washing and Drying

1) One hundred (100) parts of the colored particulate material dispersion (1) was filtered under a reduced pressure to prepare a cake.

2) One hundred (100) parts of ion-exchanged water was added to the cake and the mixture was agitated for 10 minutes with a TK HOMOMIXER mixer rotated at a revolution of 12,000 rpm, followed by filtering to prepare a cake (a).

3) One hundred (100) parts of a 10% aqueous solution of sodium hydroxide was added to the cake (a), and the mixture was agitated for 30 minutes by the TK HOMOMIXER mixer rotated at a revolution of 12,000 rpm, followed by filtering under a reduced pressure to prepare a cake (b).

4) One hundred (100) parts of a 10% aqueous solution of hydrochloric acid was added to the cake (b), and the mixture was agitated for 10 minutes by the TK HOMOMIXER mixer rotated at a revolution of 12,000 rpm, followed by filtering to prepare a cake (c).

5) Three hundred (300) parts of ion-exchanged water was added to the filtered cake (c) and the mixture was agitated for 10 minutes by the TK HOMO MIXER mixer rotated at a speed of 12,000 rpm, followed by filtering. This operation was performed twice to prepare a colored particulate material cake (1).

The colored particulate material cake (1) was dried for 48 hours at 45° C. using an air dryer, followed by sieving with a screen having openings of 75 μm to prepare colored particulate material (A) (i.e., a mother toner (A)).

II. Preparation of Toner Using Dry Method

Pulverization Method

The following components were mixed.

| | |
|---|---|
| Polyester resin<br>(polyester resin prepared by using an ethylene oxide adduct of bisphenol A and terephthalic acid as main components, and having weight average molecular weight of $1.1 \times 10^4$, number average molecular weight of $3.9 \times 10^3$, melt viscosity (η) of 90 Pa · s at 140° C., and glass transition temperature (Tg) of 69° C.) | 100 parts |
| Terpene-modified novolac resin<br>(having weight average molecular weight of 2,500, melting point (Tm) of 165° C., and melt viscosity (η) of 85,000 Pa · s at 140° C.) | 20 parts |
| Carbon black<br>(Cabot Corp.) | 5 parts |
| Charge controlling agent<br>(BONTRON E84 from Orient Chemical Industries Ltd.) | 2 parts |

-continued

| | |
|---|---|
| Low molecular weight polypropylene<br>(VISCOSE 660P from Sanyo Chemical Industries Ltd.) | 5 parts |

The mixture was fed to a two-roll mill and then kneaded for 15 minutes while heated. After being dried, the kneaded mixture was pulverized by a jet mill, followed by air classification using an air classifier. Thus, a colored particulate material (B) having a volume average particle diameter of 6 μm were prepared.

III. Preparation of Particulate Hydroxyapatite

Particulate crystalline hydroxyapatites having a rod/needle-shape or a plate-shape for use as external additive of the toner of the present invention were prepared as follows.

(1) Preparation of Particulate Crystalline Hydroxyapatite A

Initially, 187.5 ml of water was added to 75 ml of a 0.5 mol/l aqueous solution of calcium nitrate, and a 1.0 mol/l aqueous solution of ammonia was added thereto to adjust the pH of the mixture so as to be 10. Next, 45 ml of a 0.5 mol/l aqueous solution of diammonium hydrogen phosphate was added thereto, and the mixture was agitated for 30 minutes at 20° C. The mixture was then subjected to a centrifugal separation treatment, and the supernatant liquid was removed therefrom to obtain a particulate amorphous hydroxyapatite.

Next, the thus-prepared particulate amorphous hydroxyapatite was washed with a 0.03 mol/l aqueous solution of sodium disulfosuccinate, and the mixture was subjected to a centrifugal separation treatment to remove the supernatant. After this washing treatment was repeated twice, the hydroxyapatite was aged for 12 hours at 30° C. Next, the hydroxyapatite was washed with acetone, followed by a centrifugal separation treatment and vacuum drying. Thus, a particulate crystalline hydroxyapatite A was prepared.

The shape, particle diameter and aspect ratio of the particulate crystalline hydroxyapatite A were determined using a field emission scanning electron microscope (FE-SEM) S-4200 from Hitachi Ltd. Specifically, 300 particles were randomly selected from a microscopic image of the particulate crystalline hydroxyapatite A taken by the field emission scanning electron microscope, and the images of the 300 particles were analyzed by an image analyzer LUZEX AP from Nireco Corporation using an interface. As a result of the analysis, the average particle diameter and average aspect ratio of the particulate crystalline hydroxyapatite A were 7 nm and 25, respectively.

(2) Preparation of Particulate Crystalline Hydroxyapatite B

The procedure for preparation of the particulate crystalline hydroxyapatite A was repeated except that the temperature in the aging treatment was changed from 30° C. to 70° C. to prepare a particulate crystalline hydroxyapatite B. As a result of the analysis, the average particle diameter and average aspect ratio of the particulate crystalline hydroxyapatite B were 12 nm and 18, respectively.

(3) Preparation of Particulate Crystalline Hydroxyapatite C

The procedure for preparation of the particulate crystalline hydroxyapatite A was repeated except that the temperature in the aging treatment was changed from 30° C. to 100° C. to prepare a particulate crystalline hydroxyapatite C. As a result of the analysis, the average particle diameter and average aspect ratio of the particulate crystalline hydroxyapatite C were 25 nm and 12, respectively.

(4) Preparation of Particulate Crystalline Hydroxyapatite D

The procedure for preparation of the particulate crystalline hydroxyapatite A was repeated except that the temperature in the aging treatment was changed from 30° C. to 180° C. to prepare a particulate crystalline hydroxyapatite D. As a result of the analysis, the average particle diameter and average aspect ratio of the particulate crystalline hydroxyapatite D were 36 nm and 3, respectively.

(5) Preparation of Particulate Amorphous Hydroxyapatite E

Initially, 187.5 ml of water was added to 75 ml of a 0.5 mol/l aqueous solution of calcium nitrate, and a 1.0 mol/l aqueous solution of ammonia was added thereto to adjust the pH of the mixture so as to be 10. Next, 45 ml of a 0.5 mol/l aqueous solution of diammonium hydrogen phosphate was added thereto, and the mixture was agitated for 30 minutes at 20° C. The mixture was then subjected to a centrifugal separation treatment, and the supernatant liquid was removed therefrom to obtain a particulate amorphous hydroxyapatite E.

As a result of the analysis, the average particle diameter and average aspect ratio of the particulate amorphous hydroxyapatite E were 17 nm and 1, respectively.

(6) Preparation of Particulate Crystalline Hydroxyapatite F

The procedure for preparation of the particulate crystalline hydroxyapatite A was repeated except that the temperature in the aging treatment was changed from 30° C. to 120° C. and the aging treatment time was changed from 12 hours to 1 hour to prepare a particulate crystalline hydroxyapatite F. As a result of the analysis, the average particle diameter and average aspect ratio of the particulate crystalline hydroxyapatite F were 8 nm and 2, respectively.

(7) Preparation of Particulate Crystalline Hydroxyapatite G

The procedure for preparation of the particulate crystalline hydroxyapatite A was repeated except that the temperature in the aging treatment was changed from 30° C. to 100° C. and the aging treatment time was changed from 12 hours to 24 hours to prepare a particulate crystalline hydroxyapatite G. As a result of the analysis, the average particle diameter and average aspect ratio of the particulate crystalline hydroxyapatite G were 17 nm and 33, respectively.

(8) Preparation of Particulate Crystalline Hydroxyapatite H

The procedure for preparation of the particulate crystalline hydroxyapatite A was repeated except that the temperature in the aging treatment was changed from 30° C. to 40° C. and the aging treatment time was changed from 12 hours to 1 hour to prepare a particulate crystalline hydroxyapatite H. As a result of the analysis, the average particle diameter and average aspect ratio of the particulate crystalline hydroxyapatite H were 36 nm and 1, respectively.

(9) Preparation of Particulate Crystalline Hydroxyapatite I

The procedure for preparation of the particulate crystalline hydroxyapatite A was repeated except that the temperature in the aging treatment was changed from 30° C. to 120° C. and the aging treatment time was changed from 12 hours to 4 hours to prepare a particulate crystalline hydroxyapatite I. As a result of the analysis, the average particle diameter and average aspect ratio of the particulate crystalline hydroxyapatite I were 8 nm and 4, respectively.

(10) Preparation of Particulate Crystalline Hydroxyapatite J

The procedure for preparation of the particulate crystalline hydroxyapatite A was repeated except that the temperature in the aging treatment was changed from 30° C. to 40° C. and the aging treatment time was changed from 12 hours to 24 hours to prepare a particulate crystalline hydroxyapatite J. As a result of the analysis, the average particle diameter and average aspect ratio of the particulate crystalline hydroxyapatite J were 33 nm and 22, respectively.

(11) Preparation of Particulate Crystalline Hydroxyapatite L

The procedure for preparation of the particulate crystalline hydroxyapatite A was repeated except that the temperature in the aging treatment was changed from 30° C. to 120° C. and the aging treatment time was changed from 12 hours to 1 hour to prepare a particulate crystalline hydroxyapatite L. As a result of the analysis, the average particle diameter and average aspect ratio of the particulate crystalline hydroxyapatite L were 8 nm and 2, respectively.

(12) Preparation of Plate-Shaped Particulate Crystalline Hydroxyapatite M

One (1) liter of ion-exchange water was fed into a 10-liter temperature-controllable beaker, and 86 g of a powder $CaHPO_4.2H_2O$ and 35 g of $CaCO_3$ were fed into the beaker while agitating the mixture to prepare a suspension. The suspension was heated to 60° C. and the temperature was maintained for 300 minutes while agitated to perform a reaction. The reaction product liquid was subjected to a filtering treatment using a Nutsche, and the resultant cake was dried for 180 minutes at 150° C. Thus, 85 g of a reaction product was obtained. The reaction product was then subjected to a dissociating treatment using a scrum jet mill (MN-30 from Tokuju Corporation) to dissociate aggregated particles. Thus, a plate-shaped particulate crystalline hydroxyapatite M was prepared. As a result of the analysis, the average particle diameter of the particulate crystalline hydroxyapatite M was 12 nm.

(13) Preparation of Plate-Shaped Particulate Crystalline Hydroxyapatite N

The procedure for preparation of the plate-shaped particulate crystalline hydroxyapatite M was repeated except that the reaction time was changed from 300 minutes to 420 minutes. Thus, a plate-shaped particulate crystalline hydroxyapatite N was prepared. As a result of the analysis, the average particle diameter of the plate-shaped particulate crystalline hydroxyapatite N was 50 nm.

(14) Preparation of Plate-Shaped Particulate Crystalline Hydroxyapatite O

The procedure for preparation of the plate-shaped particulate crystalline hydroxyapatite M was repeated except that the reaction time was changed from 300 minutes to 540 minutes. Thus, a plate-shaped particulate crystalline hydroxyapatite O was prepared. As a result of the analysis, the average particle diameter of the plate-shaped particulate crystalline hydroxyapatite O was 121 nm.

(15) Preparation of Plate-Shaped Particulate Crystalline Hydroxyapatite P

The procedure for preparation of the plate-shaped particulate crystalline hydroxyapatite M was repeated except that the reaction time was changed from 300 minutes to 720 minutes. Thus, a plate-shaped particulate crystalline hydroxyapatite P was prepared. As a result of the analysis, the average particle diameter of the plate-shaped particulate crystalline hydroxyapatite O was 248 nm.

IV. Preparation of Carrier

A carrier used for preparing developers and for measuring charge quantities of toners was prepared as follows.

The following components were dissolved or dispersed in toluene to prepare a coating liquid.

| | |
|---|---|
| Silicone resin solution (from Shin-Etsu Chemical Co., Ltd.) | 200 parts |
| Carbon black (from Cabot Corp.) | 3 parts |

Next, 2,500 parts of a ferrite core material, which has a relatively sharp particle diameter distribution and an average particle diameter of from 30 μm to 60 μm, was coated with the above-prepared coating liquid by a fluidized-bed type spraying method, and the coated ferrite core was heated for 2 hours at 300° C. using an electric furnace.

Thus, a carrier was prepared.

Toner Preparation Example 1

Initially, 100 parts of the colored particulate material A was mixed with 0.5 parts of the particulate crystalline hydroxyapatite A, which has a number average particle diameter of 7 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 8 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner A was prepared.

Toner Preparation Example 2

Initially, 100 parts of the colored particulate material A was mixed with 0.85 parts of the particulate crystalline hydroxyapatite B, which has a number average particle diameter of 12 nm, using a HENSCEL MIXER mixer, whose agitating blade was rotated at a peripheral speed of 20 m/sec. Next, 1.0 part of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner B was prepared.

Toner Preparation Example 3

Initially, 100 parts of the colored particulate material A was mixed with 1.0 part of the particulate crystalline hydroxyapatite C, which has a number average particle diameter of 25 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 1.2 parts of a silica, which has an average particle diameter of 20 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner C was prepared.

Toner Preparation Example 4

Initially, 100 parts of the colored particulate material A was mixed with 1.2 parts of the particulate crystalline hydroxyapatite C, which has a number average particle diameter of 36 nm, using a HENSCEL MIXER mixer, whose agitating blade was rotated at a peripheral speed of 20 m/sec. Next, 1.0 part of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner D was prepared.

Toner Preparation Example 5

Initially, 100 parts of the colored particulate material B was mixed with 0.5 parts of the particulate crystalline hydroxyapatite I, which has a number average particle diameter of 8 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 8 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner I was prepared.

Toner Preparation Example 6

Initially, 100 parts of the colored particulate material B was mixed with 1.2 parts of the particulate crystalline hydroxyapatite J, which has a number average particle diameter of 33 nm, using a HENSCEL MIXER mixer, whose agitating blade was rotated at a peripheral speed of 20 m/sec. Next, 1.2 parts of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner J was prepared.

Toner Preparation Example 7

Initially, 100 parts of the colored particulate material A was mixed with 0.5 parts of the plate-shaped particulate crystalline hydroxyapatite M, which has a number average particle diameter of 12 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 8 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner M was prepared.

Toner Preparation Example 8

Initially, 100 parts of the colored particulate material B was mixed with 0.85 parts of the plate-shaped particulate crystalline hydroxyapatite N, which has a number average particle diameter of 50 nm, using a HENSCEL MIXER mixer, whose agitating blade was rotated at a peripheral speed of 20 m/sec. Next, 1.0 part of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner N was prepared.

Toner Preparation Example 9

Initially, 100 parts of the colored particulate material A was mixed with 1.0 part of the plate-shaped particulate crystalline hydroxyapatite O, which has a number average particle diameter of 121 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 1.2 parts of a silica, which has an average particle diameter of 20 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner O was prepared.

Toner Preparation Example 10

Initially, 100 parts of the colored particulate material A was mixed with 1.2 parts of the plate-shaped particulate crystalline hydroxyapatite P, which has a number average particle diameter of 248 nm, using a HENSCEL MIXER mixer, whose agitating blade was rotated at a peripheral speed of 20 m/sec. Next, 1.0 part of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner P was prepared.

Toner Preparation Example 11

Initially, 100 parts of the colored particulate material B was mixed with 0.5 parts of the plate-shaped particulate crystalline hydroxyapatite M, which has a number average particle diameter of 12 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 8 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner Q was prepared.

Toner Preparation Example 12

Initially, 100 parts of the colored particulate material B was mixed with 1.2 parts of the plate-shaped particulate crystalline hydroxyapatite P, which has a number average particle diameter of 248 nm, using a HENSCEL MIXER mixer, whose agitating blade was rotated at a peripheral speed of 20 m/sec. Next, 1.2 parts of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner R was prepared.

Comparative Toner Preparation Example 1

Initially, 100 parts of the colored particulate material A was mixed with 0.85 parts of the particulate amorphous hydroxyapatite E, which has a number average particle diameter of 17 nm, using a HENSCEL MIXER mixer, whose agitating blade was rotated at a peripheral speed of 20 m/sec. Next, 1.0 part of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner E was prepared.

Comparative Toner Preparation Example 2

Initially, 100 parts of the colored particulate material A was mixed with 0.5 parts of the particulate crystalline hydroxyapatite F, which has a number average particle diameter of 8 nm, using a HENSCEL MIXER mixer, whose agitating blade was rotated at a peripheral speed of 20 m/sec. Next, 1.0 part of a silica, which has an average particle diameter of 20 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner F was prepared.

Comparative Toner Preparation Example 3

Initially, 100 parts of the colored particulate material A was mixed with 0.85 parts of the particulate crystalline hydroxyapatite G, which has a number average particle diameter of 17 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 1.2 parts of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner G was prepared.

Comparative Toner Preparation Example 4

Initially, 100 parts of the colored particulate material A was mixed with 1.2 parts of the particulate crystalline hydroxyapatite H, which has a number average particle diameter of 36 nm, using a HENSCEL MIXER mixer, whose agitating blade was rotated at a peripheral speed of 20 m/sec. Next, 1.0 part of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 8 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner H was prepared.

Comparative Toner Preparation Example 5

Initially, 100 parts of the colored particulate material B was mixed with 0.85 parts of the particulate amorphous hydroxyapatite E, which has a number average particle diameter of 17 nm, using a HENSCEL MIXER mixer, whose agitating blade was rotated at a peripheral speed of 20 m/sec. Next, 0.75 parts of a rutile-type titanium dioxide, which has an average particle diameter of 15 nm and which had been hydrophobized using isobutyltrimethoxysilane, was added thereto, and the mixture was agitated by the HENSCEL MIXER mixer, whose agitating blade was rotated at a peripheral speed of 35 m/sec. Further, 0.8 parts of a silica, which has an average particle diameter of 12 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner K was prepared.

Comparative Toner Preparation Example 6

Initially, 100 parts of the colored particulate material B was mixed with 0.5 parts of the particulate crystalline hydroxyapatite L, which has a number average particle diameter of 8 nm, using a HENSCEL MIXER mixer, whose agitating blade was rotated at a peripheral speed of 20 m/sec. Next, 1.0 part of a silica, which has an average particle diameter of 20 nm and which had been hydrophobized by hexamethyldisilazane, was added thereto, and the mixture was agitated by the HENSCEL MIXER mixer, whose agitating blade was rotated at a peripheral speed of 35 m/sec.

Thus, a toner L was prepared.

Evaluation of Toners

The image forming apparatus used for evaluating the toners is as follows.

The image forming apparatus includes a photoreceptor drum serving as an image bearing member, a charging roller configured to charge the photoreceptor drum with a small gap therebetween, an irradiating device configured to irradiate the charged photoreceptor drum with light to form an electrostatic latent image on the photoreceptor drum, a developing device configured to develop the electrostatic latent image with a two-component developer including a toner to form a toner image on the photoreceptor drum, a transfer belt configured to transfer the toner image onto a recording paper, a fixing device configured to fix the toner image upon application of heat and pressure thereto, a cleaning device configured to remove residual toner from the surface of the photoreceptor drum, a discharging lamp configured to decay residual charges on the photoreceptor drum, an optical sensor configured to measure the concentration of toner in the developer, a toner bottle configured to contain one of the toners prepared above, and a toner supplying device configured to supply the toner to the developing device. In this regard, the voltage applied to the photoreceptor drum by the charging device and the concentration of toner in the developer are controlled.

The image forming operation is performed as follows.

Initially, the photoreceptor drum is rotated, and is subjected to a discharging treatment by the discharging lamp so that the surface of the photoreceptor drum has a potential of from 0 to −150V. Next, the photoreceptor drum is charged by the charging roller so that the surface of the photoreceptor drum has a potential of about −1,000V. Further, the irradiating device irradiates the charged photoreceptor with light so that an electrostatic latent image is formed on the photoreceptor and an irradiated portion of the surface of the photoreceptor drum has a potential of from 0 to −200V. A developing sleeve of the developing device develops the electrostatic latent image with a two-component developer, which includes one of the toners prepared above and which is present on the developing sleeve, resulting in formation of a toner image on the surface of the photoreceptor drum. The transfer belt transfers the toner image onto a recording paper, and the fixing device fixes the toner image to the recording paper. The recording paper bearing the fixed toner image thereon is then discharged from the image forming apparatus, resulting in formation of a copy. Residual toner particles on the surface of the photoreceptor drum are removed therefrom by a cleaning blade of the cleaning device, and residual charges on the surface of the photoreceptor drum are removed by the discharging lamp so that the photoreceptor drum is ready for the next image forming operation.

The two-component developer for use in the image forming apparatus was prepared as follows.

Each of the toners (T) prepared above was mixed with the above-prepared coated carrier (C) in a weight ratio (T/C) of 7/93. The mixture was agitated for 5 minutes using a ball mill to prepare developers including the toners.

Each of the thus-prepared developers was evaluated with respect to the following items.

1. Cleanability of Toner

A running test, in which 5,000 copies of an original image are continuously produced using the image forming apparatus, was performed using each developer under an environmental condition of 10° C. and 15% RH. After the running test, a white image was formed. At a time in which the white toner image was transferred onto a recording paper and then the surface of the photoreceptor drum was cleaned by the cleaning device, the image forming apparatus was stopped, and an adhesive tape (SCOTCH TAPE from Sumitomo 3M Ltd.) was attached to a surface portion of the photoreceptor drum to transfer residual toner particles on the photoreceptor drum to the adhesive tape. The adhesive tape bearing the residual toner particles and the adhesive tape bearing no toner particles (i.e., the blank adhesive tape) were attached to a white paper, and the optical densities of the two pieces of tape attached to the white paper were measured with a reflection densitometer (MECBETH RD 514) to determine the optical density difference between the optical densities.

The cleanability of toners is graded as follows.

○: The optical density difference is less than 0.01. (Good)

Δ: The optical density difference is not less than 0.01 and less than 0.02. (Acceptable)

X: The optical density difference is not less than 0.02. (Unacceptable)

The evaluation results are shown in Table 1 below.

2. Filming Resistance of Toner

A running test, in which 30,000 copies of a test chart having an image area ratio of 6% are continuously produced using the above-mentioned image forming apparatus, was performed using each developer under an environmental condition of 10° C. and 15% RH. In this regard, the produced copies were observed after every 1,000 copies to determine whether the image has an abnormal white spot image caused by filming of the toner. Specifically, the number of the copy in which an abnormal white spot image is first observed is described in Table 1 below. Therefore, the larger the number, the better the filming resistance of the toner.

3. Image Quality 3-1 Transfer Property

After the 5,000-copy running test mentioned above in paragraph 1, a cyan solid image was produced, and the solid image was observed to determine whether or not deficient image transfer occurs.

3-2 Background Development

After the 5,000-copy running test mentioned above in paragraph 1, a white image was formed. At a time in which the white toner image on the photoreceptor drum was not transferred onto a recording paper, the image forming apparatus was stopped, and an adhesive tape (SCOTCH TAPE from Sumitomo 3M Ltd.) was attached to a portion of the white image formed on the photoreceptor drum to transfer toner particles on the photoreceptor drum to the adhesive tape. The adhesive tape bearing the toner particles and the adhesive tape bearing no toner particles (i.e., the blank adhesive tape) were attached to a white paper, and the optical densities of the two pieces of tape attached to the white paper were measured with a reflection densitometer (MECBETH RD 514) to determine the optical density difference between the optical densities.

The background development property of the toners is graded as follows.

○: The optical density difference is less than 0.30. (Good)

X: The optical density difference is not less than 0.30. (Unacceptable)

The image quality of a toner is graded as follows in consideration of both the transfer property and background development property thereof.

○: The image quality is good.

Δ: The image quality is acceptable.

X: The image quality is unacceptable.

The evaluation results are shown in Table 1.

4. Charge Stability

Each of the developers was aged for 24 hours under an environmental condition of 35° C. and 85% RH. After the developer was agitated for 1 minute using a ball mill, the developer was subjected to a blow-off treatment to measure the charge (Q1) of the toner using an instrument TB-200 from Toshiba Chemical Corporation. In addition, after the aged developer was agitated for 60 minutes using the ball mill, the developer was subjected to a blow-off treatment to measure the charge (Q60) of the toner using the instrument. The charge stability of the toner under the high temperature and high humidity condition was graded using the following parameter Qst.

$$Qst=|1-(Q(60)/Q(1))|\times 100$$

○: The parameter Qst is not greater than 20. (Good)

Δ: The parameter Qst is greater than 20 and not greater than 40. (Acceptable)

X: The parameter Qst is greater than 40. (Unacceptable)

5. Scratch on Photoreceptor (Photoreceptor Damaging Property of Toner)

After a running test, in which A-4 size 100,000 copies of an original image having an image area ratio of 4% are continuously produced, was performed, the surface of the photoreceptor drum was observed to determine whether the surface has scratches. This photoreceptor damaging property of toner is graded as follows.

○: There is no scratch on the surface of the photoreceptor, or there is a minor scratch thereon but the image quality is not deteriorated thereby. (Good)

Δ: There are minor scratches on the surface of the photoreceptor, which hardly deteriorate the image quality. (Acceptable)

X: There are scratches on the surface of the photoreceptor, which deteriorate the image quality or which is so heavy as not to be restored.

The evaluation results are shown in Table 1.

TABLE 1

| | Toner | Cleanability | Filming resistance | Image quality | Charge stability | Scratch on photo-receptor |
|---|---|---|---|---|---|---|
| Ex. 1 | A | Δ | 26000 | ○ | Δ | ○ |
| Ex. 2 | B | ○ | >30000* | ○ | ○ | ○ |
| Ex. 3 | C | ○ | >30000* | ○ | ○ | ○ |
| Ex. 4 | D | ○ | >30000* | Δ | Δ | ○ |
| Ex. 5 | I | ○ | >30000* | ○ | ○ | ○ |
| Ex. 6 | J | ○ | 29000 | Δ | ○ | ○ |
| Ex. 7 | M | ○ | >30000* | ○ | Δ | ○ |
| Ex. 8 | N | ○ | >30000* | ○ | ○ | ○ |
| Ex. 9 | O | ○ | >30000* | ○ | ○ | ○ |
| Ex. 10 | P | ○ | 28000 | ○ | ○ | Δ |
| Ex. 11 | Q | Δ | >30000* | Δ | ○ | ○ |
| Ex. 12 | R | ○ | 26000 | ○ | ○ | Δ |
| Comp. Ex. 1 | E | Δ | 12000 | Δ | X | ○ |
| Comp. Ex. 2 | F | ○ | 5000 | X | X | ○ |
| Comp. Ex. 3 | G | X | 11000 | ○ | Δ | X |
| Comp. Ex. 4 | H | ○ | 9000 | X | Δ | Δ |
| Comp. Ex. 5 | K | ○ | >30000* | X | Δ | ○ |
| Comp. Ex. 6 | L | Δ | >30000* | ○ | X | ○ |

>30000*: Abnormal white spot image was not formed in the 30,000-copy running test.

It can be understood from Table 1 that the toner of the present invention can produce high quality images without damaging the photoreceptor, namely, by using a special crystalline hydroxyapatite as an external additive of toner, deterioration of the properties of toner (such as cleanability, filming resistance, transferability, and charge stability) due to the wax and alcohol exuding phenomenon mentioned above can be prevented.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application Nos. 2009-278604 and 2010-169083, filed on Dec. 8, 2009 and Jul. 28, 2010, respectively, the entire contents of which are herein incorporated by reference.

What is claimed is:

1. A toner comprising:

a colored particulate material comprising a binder resin and a colorant; and an external additive present on a surface of the colored particulate material and comprising a particulate crystalline hydroxyapatite having an average aspect ratio of not less than 22 and less than 30 or a plate-shaped particulate crystalline hydroxyapatite.

2. The toner according to claim 1, wherein the external additive further comprises at least one particulate material selected from the group consisting of silica, titanium compounds, alumina, cerium oxide, calcium carbonate, magnesium carbonate, calcium phosphate, fluorine-containing resins, silicon-including resins, and nitrogen-containing resins.

3. The toner according to claim 2, wherein the external additive comprises a titanium compound, which is prepared by reacting at least part of $TiO(OH)_2$, which is prepared by a wet method, with a silane compound or a silicone oil.

4. The toner according to claim 2, wherein the external additive comprises a titanium compound having a specific gravity of from 2.8 to 3.6.

5. The toner according to claim 1, wherein the binder resin comprises a resin prepared by a wet method comprising:

dissolving or dispersing a compound having an active hydrogen, and a polyester resin reactive with an active hydrogen in an organic solvent to prepare a resin component liquid;

dispersing the resin component liquid in an aqueous medium comprising a particulate resin to prepare an emulsion; and reacting the polyester resin with the compound having an active hydrogen to prepare the binder resin.

6. The toner according to claim 1, wherein the colored particulate material is prepared by a pulverization method comprising:

heating toner components including at least the binder resin, and the colorant;

kneading the heated toner components;

cooling the kneaded toner components;

pulverizing the kneaded toner components to prepare toner component particles; and classifying the pulverized toner component particles to prepare the colored particulate material.

7. A developer comprising:

the toner according to claim 1; and a carrier.

8. The toner according to claim 1, wherein the external additive comprises a particulate crystalline hydroxyapatite having an average aspect ratio of not less than 22 and less than 30.

9. The toner according to claim 1, wherein the external additive comprises a plate-shaped particulate crystalline hydroxyapatite.

* * * * *